United States Patent [19]

Middleman et al.

[11] 4,315,237

[45] Feb. 9, 1982

[54] PTC DEVICES COMPRISING OXYGEN BARRIER LAYERS

[75] Inventors: Lee M. Middleman, Portola Valley; Alan J. Gotcher, Saratoga, both of Calif.

[73] Assignee: Raychem Corporation, Menlo Park, Calif.

[21] Appl. No.: 98,711

[22] Filed: Nov. 30, 1979

Related U.S. Application Data

[63] Continuation-in-part of Ser. No. 965,345, Dec. 1, 1978, abandoned.

[51] Int. Cl.[3] ..... H01C 7/02

[52] U.S. Cl. ..... 338/22 R; 219/505; 338/275

[58] Field of Search ..... 338/22 R, 225 D, 223, 338/224, 225, 275; 219/505; 361/106; 29/612; 252/502, 503, 512

[56] References Cited

U.S. PATENT DOCUMENTS

| | | | |
|---|---|---|---|
| 2,861,163 | 11/1958 | Asakawa | 338/224 X |
| 3,239,785 | 3/1966 | Johns et al. | 338/22 R |
| 3,243,753 | 3/1966 | Kohler | 338/31 |
| 3,619,560 | 11/1971 | Baiting et al. | 219/210 X |
| 3,824,328 | 7/1974 | Ting et al. | 338/22 R X |
| 3,858,141 | 12/1974 | Bedard et al. | 338/22 R |
| 3,914,363 | 10/1975 | Bedard et al. | 338/214 |
| 4,151,401 | 4/1979 | VanBokestal et al. | 338/22 R X |
| 4,238,812 | 12/1980 | Middleman et al. | 338/22 R X |

FOREIGN PATENT DOCUMENTS

| | | |
|---|---|---|
| 988184 | 4/1965 | United Kingdom . |
| 1167551 | 10/1969 | United Kingdom . |
| 1168162 | 10/1969 | United Kingdom . |
| 1458720 | 12/1976 | United Kingdom . |

OTHER PUBLICATIONS

J. Meyer, *Polymer Engineering and Science*, "Glass Transition Temperature as a Guide to Selection of Polymers Suitable for PTC Materials", vol. 13, No. 6, 11/73.

*Primary Examiner*—C. L. Albritton
*Attorney, Agent, or Firm*—Lyon & Lyon

[57] ABSTRACT

Electrical devices comprising PTC elements have improved electrical stability when they comprise an oxygen barrier which restricts access of air to the element so that the PTC element absorbs oxygen at a rate less than $10^{-6}$ cc/sec/gram. The devices are for example circuit control devices or self-limiting heaters. Preferred PTC elements comprise a polymer having dispersed therein carbon black and an additive which stabilizes the polymer against degradation, especially an organic antioxidant. The oxygen barrier may for example be a layer of a polymeric composition or a self-supporting container principally made of metal and filled with an inert gas.

29 Claims, 6 Drawing Figures

PTC DEVICES COMPRISING OXYGEN BARRIER LAYERS

CROSS-REFERENCE TO RELATED APPLICATIONS

This application is a continuation-in-part of our application Ser. No. 965,345 filed Dec. 1, 1978, now abandoned, the disclosure of which is incorporated by reference herein.

This application is related to Application Ser. No. 965,344 of Middleman et al. and Application Ser. No. 965,343 of van Konynenburg, both filed Dec. 1, 1978, and the continuation-in-part of Ser. No. 965,344 thereof, Ser. No. 98,712, filed contemporaneously with this application.

BACKGROUND OF THE INVENTION

1. Field of the Invention

This invention relates to electrical devices comprising PTC elements.

2. Summary of the Prior Art

Conductive polymer compositions, i.e. compositions comprising a polymer and conductive particles dispersed in the polymer, are well known. Over recent years there has been particular interest in such compositions which exhibit positive temperature coefficient (PTC) behavior, i.e. which show a sharp increase in resistivity over a particular range, and in electrical devices comprising PTC elements composed of such PTC compositions. Reference may be made for example to U.S. Pat. No. 3,858,144 and to copending and commonly assigned Application Ser. Nos. 601,638 (Horsma et al.), U.S. Pat. No. 4,177,376, 750,149 (Kamath et al.), now abandoned, 751,095 (Toy et al.), now abandoned, 798,154 (Horsma), now abandoned 873,676 (Horsma), 965,343 (Van Konynenburg et al.) and 965,344 (Middleman et al.) and the continuation-in-part of Ser. No. 965,344 Ser. No. 98,712 filed contemporaneously with this application. The disclosure of this patent and these applications is incorporated by reference herein. It is known that devices of this kind may comprise a jacket of a polymeric material which insulates the device electrically and also provides physical protection. Thus the self-limiting PTC heaters have insulating jackets of thermoplastic polymers which may be cross-linked. U.S. Pat. No. 3,914,363 (Bedard) discloses that it is useful for the jacket to have residual stress at temperatures used for annealing the PTC composition to reduce its resistivity. U.S. Pat. No. 3,351,882 (Kohler et al.) discloses that a PTC device may have a casing of any suitable known epoxy resin or silicone rubber, but does not give any specific example of such a device.

In an article in Journal of Polymer Engineering and Science, 14, 706 (1974), J. Meyer discloses that the presence of an anti-oxidant, e.g. a hindered phenol, in a PTC composition influences the way in which the electrical properties of the composition change when the device is subjected to aging at elevated temperature.

SUMMARY OF THE INVENTION

We have now discovered that the electrical stability of devices comprising PTC elements is improved if the device comprises an oxygen barrier which substantially surrounds the PTC element.

In one aspect the invention provides an electrical device which comprises (1) a PTC element which is composed of a composition which exhibits PTC behavior with a switching temperature $T_s$ and which comprises
  (a) a macromolecular polymer; and
  (b) conductive particles dispersed in said polymer;
(2) at least two electrodes which can be connected to a source of electrical power and which, when so connected, cause current to flow through said PTC element; and
(3) an oxygen barrier which, when the device is in air at standard temperature and pressure, restricts access of air to the PTC element so that the rate at which the PTC element absorbs oxygen is less than $10^{-6}$ cc/sec/gram.

The devices of the invention preferably exhibit a change in resistance at at least one temperature between $(T_s-110)$°C. and $T_s$ (and preferably at at least one temperature between $(T_s-60)$°C. and $T_s$) of −50% to +200%, preferably −50% to +100%, after having been subjected to an active aging treatment which comprises passing current through the device for 100 hours, the current being such that $I^2R$ heating of the device maintains said PTC element at a temperature between $T_s$ and $(T_s+50)$°C. For many devices, these criteria of resistance change on aging (as defined) will be met if the device exhibits a change in resistance at 25° C. which is from −50% to +200%, preferably −50% to +100%.

BRIEF DESCRIPTION OF THE DRAWINGS

The invention is illustrated in the accompanying drawings, in which.

DETAILED DESCRIPTION OF THE INVENTION

Figure 1:
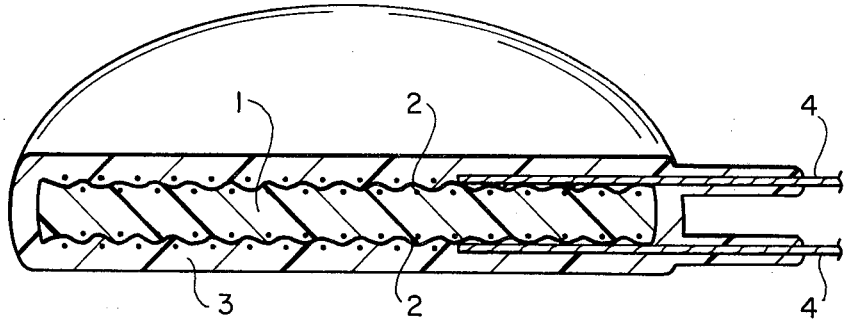
FIGS. 1, 2, 3 and 6 show devices according to the invention.

It is desirable that the resistance of the device in the operating temperature range should change as little as possible when the device is subjected to the active aging treatment defined above, and especially when subjected to such aging for 250 hours or even longer, eg. for 500 hours or 1000 hours. It is therefore preferred that the device should exhibit a change in resistance of −50% to +200%, preferably −50% to 100%, at all temperatures between $(T_s-60)$°C. and $T_s$, especially at all temperatures between $(T_s-110)$°C. and $T_s$, after such active aging treatment.

The PTC compositions used in the present invention may be any of the PTC conductive polymers disclosed in the prior art. The conductive particles preferably comprise carbon black, but other conductive particles, e.g. metal powders, metal oxides, inorganic salts and graphite, can be used. Preferred compositions comprise an organic polymer (the term polymer being used to include mixtures of polymers) having at least 10%, preferably at least 30%, crystallinity and having dispersed therein a conductive carbon black having a particle size of 20 to 250 millimicrons. The PTC composition may further comprise a non-conductive inorganic filler, e.g. zinc oxide, antimony trioxide or clay.

The PTC composition preferably comprises an antioxidant or other additive which will stabilise the composition against thermo-oxidative degradation, the amount of such additive generally being 0.005 to 10%, for example 0.01 to 6%, preferably 0.5 to 4%, by weight, based on the weight of the polymer. Preferably the additive is an organic antioxidant, for example a hindered phenol such as those disclosed in U.S. Pat. No. 3,986,981 (Lyons) and those manufactured by Ciba Geigy under the trade name Irganox. The choice of antioxidant will of course be dependent on the polymer, and it is important to note also that many materials which are generally useful as antioxidants fail to impart the desired additional electrical stability and that a number of them actually cause the electrical properties to become less stable. Antioxidants which give the desired additional electrical stability can readily be selected on a trial-and-error basis.

The oxygen barrier should restrict access of air to the PTC element so that, when the device is in air at standard temperature and pressure, the equilibrium rate at which the PTC element absorbs oxygen is less than $10^{-6}$ cc/sec/gram, preferably less than $4\times10^{-7}$ cc/sec/gram, especially less than $3\times10^{-7}$ cc/sec/gram, particularly less than $2\times10^{-7}$ cc/sec/gram. Generally the barrier will be such that, when the device is placed in air, the only oxygen which contact at least 95% of the surface of the PTC element is oxygen which has passed through the barrier layer, and preferably the barrier layer will form a hermetic seal around the device so that the only oxygen which can contact the PTC element is oxygen which has passed through the barrier. The barrier layer is preferably composed of a material having an oxygen permeability rate at 25° C. of less than $5\times10^{-9}$, especially less than $10^{-9}$, cc(STP)cm$^2$/mm/sec/cm Hg, as measured by ASTM D 1434-75. Especially when the device is one which is expected to operate in such a way that the barrier is maintained at an elevated temperature, the physical properties of the barrier, including its oxygen permeability, at elevated temperatures are preferably such that the barrier retains its structural integrity and the device has the desired electrical properties after active aging as defined above. The thickness of the barrier should be sufficient to restrict the access of air to the PTC element to the desired extent and to prevent the formation of pinholes, eg. at least 1 micron, and for polymeric materials is generally 0.001 to 0.1 inch, preferably 0.005 to 0.05 inch, especially 0.01 to 0.03 inch. The barrier preferably protects the device against mechanical abuse, and for this reason is preferably composed of a material having a Young's Modulus greater than 100,000 psi. When using such a barrier, it is preferred, in order to avoid any danger of the barrier constricting the PTC element and thus changing the electrical performance of the device, that the barrier is separated from the PTC element by a layer of material of Young's Modulus less than 1,000,000 psi, eg. an inert gas or a vacuum or a polymer. The other material can be of higher oxygen permeability than the barrier material, eg. a polysiloxane.

Suitable materials for the barrier layer include metals and polymeric compositions based on, for example, one or more polymers selected from polyvinylidene chloride, polyvinyl fluoride, polyethylene terephthalate, rubber hydrochloride, polychlorotrifluoroethylene, phenolformaldehyde resins, polyamides, epoxy resins, styrene/acrylonitrile copolymers, cellulose acetate, butadiene/acrylonitrile copolymers, polycarbonates, polystyrene, isobutylene/isoprene copolymers, polyethylene, ethylene/tetrafluoroethylene copolymers, vinylidene fluoride/hexafluoropropylene polymers and fluorinated ethylene/propylene copolymers. The continuous surface temperature of the polymer should preferably exceed the $T_s$ of the PTC elements. These polymeric compositions can contain conventional additives, but should not comprise materials which will migrate into the PTC element and have an adverse effect on its properties.

In one preferred embodiment of the invention, the device is a circuit control device and the barrier is in the form of a self-supporting container, through whose walls the electrodes pass (via suitably sealed orifices) and within which the remainder of the device is supported or suspended out of contact with the walls of the container. The container preferably does not contain any oxygen; for example it may be evacuated or filled with an inert gas such as argon or nitrogen. Typically the container will principally be made of metal, with the electrodes passing through a wall composed of a ceramic or rigid plastics material. In another preferred embodiment, the device is a heater or a circuit control device and the barrier is in the form of a layer of polymeric composition which surrounds the remainder of the device, with the volume enclosed by the layer being substantially free from voids. The barrier may be composed of a single material or two or more materials, either mixed together or as discrete components of the barrier, eg. a laminate. One or both of the electrodes may be part of the barrier. The barrier should not of course provide an electrical connection between the electrodes.

The electrodes of the devices of the invention are generally composed of metal or some other material having a resistivity of less than 0.1 ohm. cm. The electrodes may be in physical contact with the PTC element or wholly or partially separated therefrom by electrically conductive material, e.g. a conductive polymer composition which exhibits relatively constant wattage behavior, i.e. which does not exhibit PTC behavior at temperatures below the $T_s$ of the PTC element. Alternatively the electrodes can be sandwiched between the PTC element and a relatively constant wattage conductive polymer composition. Preferably at least the outer surface of each of the electrodes is composed of a metal which does not catalyse degradation of the conductive polymer which it contacts. Thus the electrodes are preferably composed of nickel, tin, silver or gold, or one of these metals coated onto copper or another metal. When a planar electrode is required, electrodes in the form of an expanded metal or wire mesh are preferred. Other electrodes which can be used include solid wires, stranded wires and braids. When using stranded wire electrodes or other electrodes which contain voids, care should be taken to ensure that these voids do not provide a passageway for air to enter the device, e.g. by filling the voids or by sealing any exposed portions thereof. In preparing the device, care should be taken to minimise contact resistance between the components.

The devices of the invention include circuit control devices, especially of the kind disclosed in the Middleman et al. application Ser. No. 965,344 referred to above, and self-limiting heaters, including strip heaters.

In one class of devices according to the invention, generally circuit control devices, the PTC element is of relatively small size, having a volume of for example less than 20 cc., often less than 10 cc. or even smaller such as less than 5 cc. or 1 cc., and the resistance of the device at 25° C. is relatively small, for example less than 50 ohms., preferably less than 10 ohms., or even small such as less than 1 ohm. or 0.5 ohm.

Figure 2:
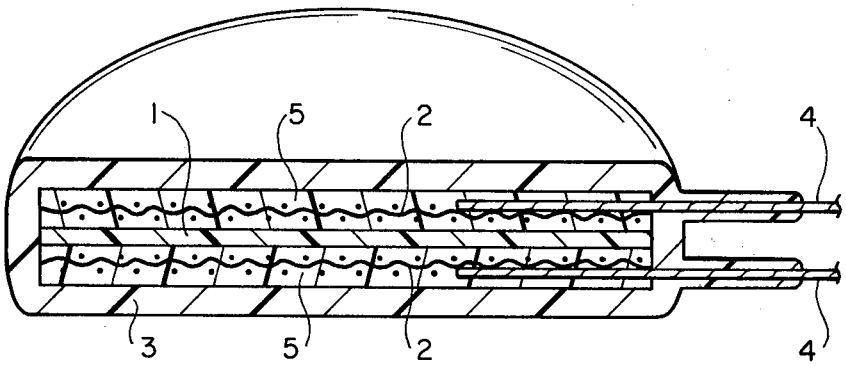
Figure 3:
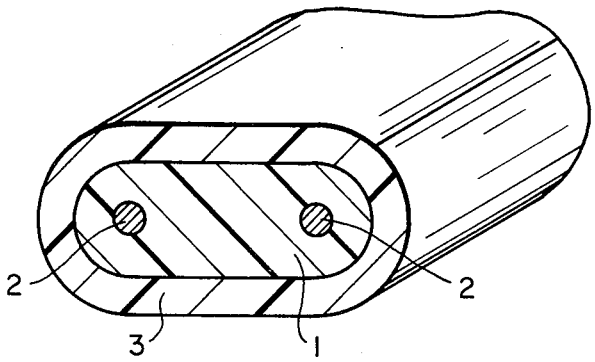

Referring now to FIGS. 1, 2, 3 and 6, these are cross-sectional views of devices of the invention. The device of FIG. 1 comprises a PTC element 1 in the form of a round disc having round mesh electrodes 2 embedded in opposite faces thereof; leads 4 are attached to the electrodes 2; and barrier layer 3 encapsulates the PTC element 1 and the electrodes 2, with leads 4 passing through it. The interface between the barrier layer 3 and the PTC element 1 and the electrodes 2 is free from voids. The device of FIG. 2 is the same as the device of FIG. 1, except that each of the electrodes is embedded in a layer 5 of a relatively constant wattage conductive polymer composition. The devices of FIGS. 1 and 2 are useful as circuit control devices. The device of FIG. 3 is a strip heater of constant cross-section comprising wire electrodes 2 embedded in PTC element 1 which is surrounded by barrier layer 3. Preferably the ends of such a heater are covered by an oxygen barrier, but it is important to note that the interface between the PTC element 1 and the barrier layer 3 is free from voids, in contrast to conventional self-limiting strip heaters in which the jacket does not adhere closely to the core, so that even if the ends of the heater are not sealed against access of oxygen, only a very limited proportion of the surface area of the PTC element is exposed to the air. By contrast, if voids are present between the jacket and the PTC element, or stranded wire electrodes are used, and the ends of the heater are not sealed, then even if the jacket is substantially impermeable to oxygen, air can percolate along the length of the PTC element and contact a substantial proportion of its surface.

Figure 6:
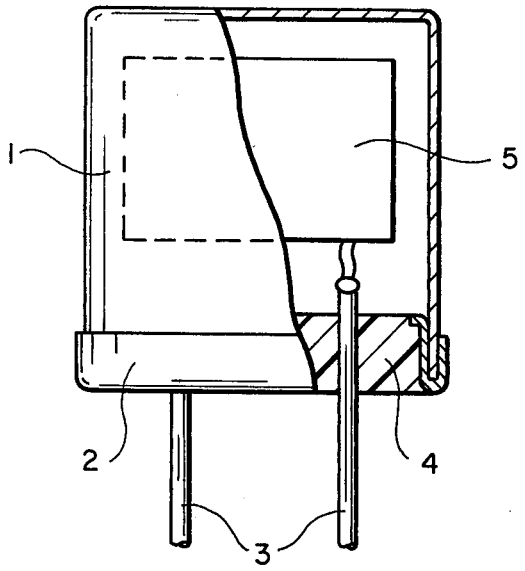

FIG. 6 shows a circuit control device in which the barrier is formed by a can of generally rectangular cross-section and having a metal top 1 and a base sealed thereto. The can is filled with nitrogen. The base comprises a metal ring 2, which has a peripheral sealing slot to which the top 1 is sealed, and a disc 4 which is sealed to the ring 2 and which is composed of glass or an epoxy resin. Pin leads 3 pass through disc 4 and support and are connected to rectangular electrodes between which is sandwiched a PTC element; the electrodes and PTC element are shown (in outline only) as 5.

Figure 4:
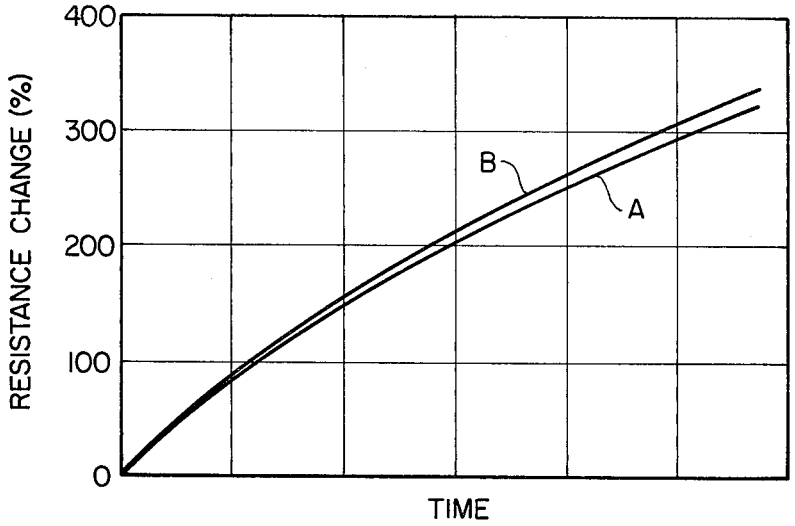
FIG. 4 shows the effect of aging on the resistance at 25° C. of known strip heaters.

FIG. 4 shows the percent change, on aging in air at 105° C., in the room temperature resistance of (A) a conventional strip heater comprising stranded nickel wire electrodes embedded in a PTC core and an insulating polyethylene jacket around the PTC core, and (B) the same heater without the jacket. The PTC core comprised carbon black polyethylene, and about 0.5% by weight of the antioxidant used in the Examples below, and both the core and the jacket had been irradiated to a dose of about 10 megarads to cross-link the composition. It will be seen that the presence of the jacket has no substantial effect on the electrical stability of the heater.

The invention is illustrated in the following Examples, in which parts and percentages are by weight except where otherwise noted. In each of the Examples, devices were prepared and tested by the procedure described below. A PTC composition was prepared by mixing the ingredients shown in the Table below; it should be noted that the polymers used were commercially available materials which contain a small quantity (about 0.5% by weight) of an antioxidant. The mixing was carried out at flux temperature for 5 minutes in a steamheated Banbury mixer with a water-cooled rotor. The mixture was dumped from the mixer, allowed to cool to room temperature and chopped into small pieces. The chopped material was compression molded at a temperature of 180° C. and a pressure of about 1,000 psi for 5 minutes into a slab 0.08 inch thick. Round discs, 0.75 inch in diameter, were punched out of the slab. An electrode was formed on each face of each disk by molding into it a disc 0.75 inch in diameter cut from an expanded metal mesh composed of nickel-coated copper. The sample was irradiated to 20 megarads to cross-link the PTC composition. 20 AWG wire leads were attached to the electrodes. Where indicated in the Table, preparation of the device was completed by surrounding the sample with a barrier as specified in the Table. In Example 2, the sample was dipped into the epoxy resin composition, which was then cured at 80° C. for 16 hours to give a barrier layer 0.01 inch thick. In Examples 3 and 5 the sample was heated to 110° C. and then dipped into a fluidised bed of the epoxy resin, which was then cured at 110° C. for 16 hours to give a barrier layer 0.01 inch thick. In Example 6, the sample was dipped into the silicone resin, which was then cured at 20° for 16 hours to give a layer 0.01 inch thick.

The electrical stability of the devices on active aging as defined above was tested as follows. The leads of the device were attached to a variable voltage AC power supply. The voltage of the supply was maintained at 120 volts except when the device was first connected or reconnected to the power supply, when the voltage was 30–45 volts for the first 30 seconds and was then increased to 120 volts over a period of 2 minutes. At intervals during the aging, the device was disconnected from the power supply and allowed to cool to room temperature for 0.5 hour, and its resistance at room temperature was then measured.

Figure 5:
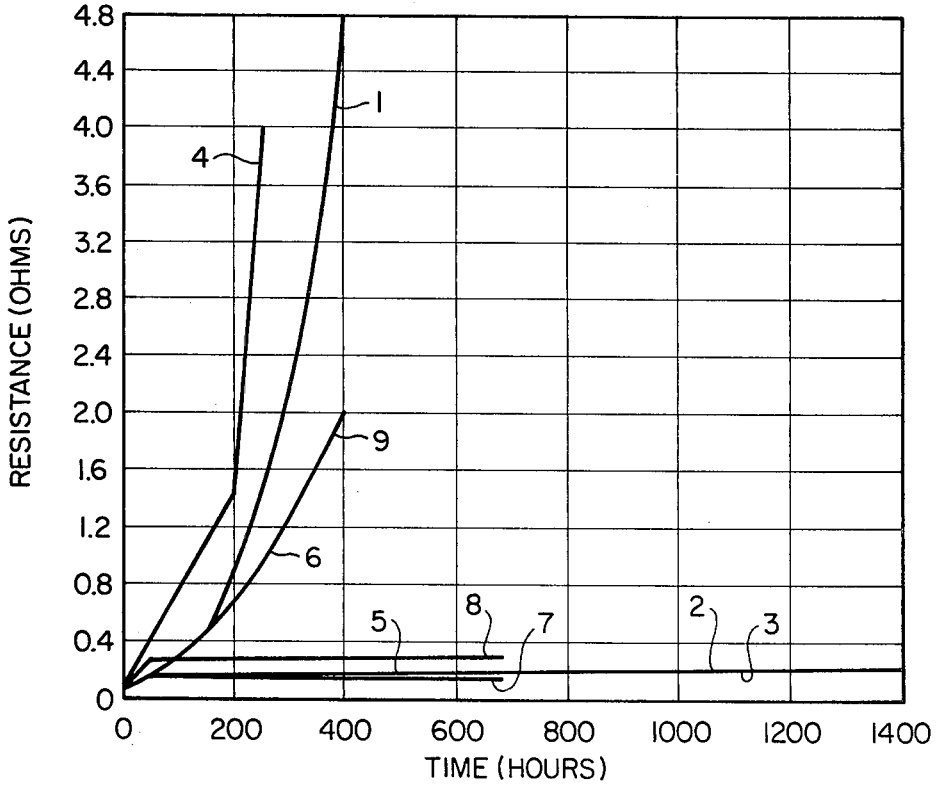
FIG. 5 shows the effect of aging on the resistance at 25° C. of various devices comprising PTC elements.

The room temperature resistance of the devices after aging as specified above is shown in FIG. 5. It will be seen that the products of Examples 1, 4, 6 and 9, which do not comprise barriers according to the invention, have poor electrical stability, whereas the products of Examples 2, 3, 5, 7 and 8, which are in accordance with the invention, have excellent stability.

The presence of the oxygen barrier in the devices of the invention has the additional advantage that if the device is subjected to electrical stress which causes breakdown of the PTC composition, the likelihood of explosive failure or conflagration is substantially reduced.

TABLE

| PTC COMPOSITION | Example No. | | | | | | | | |
|---|---|---|---|---|---|---|---|---|---|
| | 1 | 2 | 3 | 4 | 5 | 6 | 7 | 8 | 9 |
| High density Polyethylene Marlex 6003 (Phillips Petroleum) | 699.1 | 699.1 | 699.1 | 741.3 | 741.3 | 699.1 | 699.1 | 699.1 | 699.1 |
| Ethylene/acrylic acid copolymer EAA-455 (Dow Chemical) | 873.9 | 873.9 | 873.9 | 925.7 | 925.7 | 873.9 | 873.9 | 873.9 | 873.9 |
| Carbon black Furnex N-765 (City Services) | 1391.5 | 1391.5 | 1391.5 | 1358 | 1358 | 1391.5 | 1391.5 | 1391.5 | 1391.5 |

TABLE-continued

| PTC COMPOSITION | Example No. 1 | 2 | 3 | 4 | 5 | 6 | 7 | 8 | 9 |
|---|---|---|---|---|---|---|---|---|---|
| Added Antioxidant* | 60.5 | 60.5 | 60.5 | — | — | 60.5 | 60.5 | 60.5 | 60.5 |
| BARRIER | None | | | None | | | | | |
| Epoxy Resin (Hysol EE 0067 HD 7054) (oxygen permeability less than $10^{-9}$) | — | Yes | — | — | — | — | — | — | — |
| Epoxy Resin (REP 35312-40) (oxygen permeability less than $10^{-9}$) | — | — | Yes | — | Yes | — | — | — | — |
| Silicone Resin (Sylgard 170 A/B) (oxygen permeability more than $50 \times 10^{-9}$) | | — | — | — | — | Yes | — | — | — |
| Sealed Metal container under vacuum | | — | — | — | — | — | Yes | — | — |
| Sealed Metal container filled with argon | | — | — | — | — | — | — | Yes | — |
| Metal container having small hole | | — | — | — | — | — | — | — | Yes |

*An oligomer of 4,4'- thiobis (3-methyl-6-t-butyl phenol) with an average degree of polymerisation of 3-4, as described in U.S. Pat. No. 3,986,981.
The weights of the different components in the PTC composition are in grams.

We claim:

1. An electrical device which comprises
(1) a PTC element which is composed of a composition which exhibits PTC behavior with a switching temperature $T_s$ and which comprises
(a) a macromolecular polymer; and
(b) conductive particles dispersed in said polymer;
(2) at least two electrodes which can be connected to a source of electrical power and which, when so connected, cause current to flow through said PTC element; and
(3) an oxygen barrier which, when the device is in air at standard temperature and pressure, restricts access of air to the PTC element so that the rate at which the PTC element absorbs oxygen is less than $10^{-6}$ cc/sec/gram.

2. A device according to claim 1 which exhibits a change in resistance, at at least one temperature between $(T_s-110)$°C. and $T_s$, of −50% to +200%, after having been subjected to an aging treatment which comprises passing current through the device for 250 hours, the current being such that $I^2R$ heating of the device maintains said PTC element at a temperature between $T_s$ and $(T_s+50)$°C.

3. A device according to claim 1 wherein said rate at which the PTC element absorbs oxygen is less than $4\times10^{-7}$ cc/sec/gram.

4. A device according to claim 3 wherein said rate is less than $3\times10^{-7}$ cc/sec/gram.

5. A device according to claim 4 wherein said rate is less than $2\times10^{-7}$ cc/sec/gram.

6. A device according to claim 2 which exhibits a change in resistance, at at least one temperature between $(T_s-110)$°C. and $T_s$, of −50% to +100%, after having been subjected to said aging treatment.

7. A device according to claim 2 which exhibits a change in resistance, at at least one temperature between $(T_s-60)$°C. and $T_s$, of −50% to +100%, after having been subjected to said aging treatment.

8. A device according to claim 2 which exhibits a change in resistance, at at least one temperature between $(T_s-110)$°C. and $T_s$, of −50% to +200%, after having been subjected to an aging treatment which comprises passing current through the device for 500 hours, the current being such that $I^2R$ heating of the device maintains said PTC element at a temperature between $T_s$ and $(T_s+50)$°C.

9. A device according to claim 1 wherein said barrier is composed of a material having an oxygen permeability rate of less than $5\times10^{-9}$ cc(STP)/cm$^2$/mm/sec/cmHg.

10. A device according to claim 9 wherein said oxygen permeability rate is less than $10^{-9}$ cc(STP)/cm$^2$/mm/sec/cmHg.

11. A device according to claim 9 wherein said barrier is 0.001 to 0.050 inch thick and comprises at least one layer of an electrically insulating composition which comprises at least one polymer and which has a Young's Modulus greater than 100,000 psi.

12. A device according to claim 11 wherein said barrier layer is 0.01 to 0.03 inch thick.

13. A device according to claim 9 wherein said barrier comprises at least one polymer selected from the group consisting of polyvinylidene chloride, polyvinyl fluoride, polyethylene terephthalate, rubber hydrochloride, polychlorotrifluoroethylene, phenol-formaldehyde resins, polyamides, epoxy resins, styrene/acrylonitrile copolymers, cellulose acetate, butadiene/acrylonitrile copolymers, polycarbonates, polystyrene, isobutylene/isoprene copolymers, polyethylene, ethylene/tetrafluoroethylene copolymers, vinylidene fluoride/hexafluoropropylene polymers and fluorinated ethylene/propylene copolymers.

14. A device according to claim 9 wherein said barrier is such that, when the device is placed in air, the only oxygen which can contact at least 95% of the surface area of the PTC element is oxygen which has passed through the barrier layer.

15. A device according to calim 14 wherein said barrier provides a hermetic seal around said PTC element.

16. A device according to claim 9 which is a circuit control device and wherein the barrier comprises a self-supporting container which is principally made of metal, with the electrodes passing through a wall composed of a ceramic or rigid plastics material.

17. A device according to claim 16 wherein said container is filled with a gas free from oxygen.

18. A device according to claim 9 which is free from voids between said PTC element and said barrier.

19. A device according to claim 1 wherein at least one of said electrodes provides a part of said barrier.

20. A device according to claim 1 wherein said PTC composition further comprises an additive which stabilises said macromolecular polymer against degradation and which reduces said change in resistance on aging.

21. A device according to claim 20 wherein each of said electrodes is in contact with a conductive polymer composition which comprises a macromolecular polymer and conductive particles dispersed in said polymer, and at least the outer surface of each of said electrodes is composed of a metal which does not catalyse degradation of said conductive polymer composition.

22. A device according to claim 20 wherein each of said electrodes is in contact with said PTC element and at least the outer surface of each of said electrodes is composed of a metal which does not catalyse degradation of said PTC element.

23. A device according to claim 22 wherein at least the outer surface of each of said electrodes is composed of a metal selected from the group consisting of nickel, tin, silver and gold.

24. A device according to claim 1 wherein said PTC composition comprises an organic polymer having at least 10% crystallinity and having dispersed therein a carbon black having a particle size of 20 to 250 millimicrons.

25. A device according to claim 24 wherein said organic polymer is a polyolefin.

26. A device according to claim 24 wherein said PTC composition also comprises a non-conductive inorganic filler.

27. A device according to claim 9 which is a circuit control device and wherein the barrier comprises a self-supporting container.

28. A device according to claim 27 wherein the barrier comprises a polymeric material.

29. A device according to claim 28 wherein the barrier also comprises a metal.

* * * * *